United States Patent [19]

Schibbye et al.

[11] 4,453,900

[45] Jun. 12, 1984

[54] VALVE SYSTEM FOR CAPACITY CONTROL OF SCREW COMPRESSORS

[75] Inventors: Lars Schibbye, Älgvägen; Arnold Englund, Sandkullsvägen, both of Sweden

[73] Assignee: Sullair Technology AB, Stockholm, Sweden

[21] Appl. No.: 375,758

[22] Filed: May 6, 1982

[30] Foreign Application Priority Data

May 14, 1981 [SE] Sweden ..... 8103032

[51] Int. Cl.[3] ..... F01C 1/16

[52] U.S. Cl. ..... 418/99; 418/201

[58] Field of Search ..... 418/99, 201, 203, 159, 418/180, 189; 417/310, 440, 283

[56] References Cited

U.S. PATENT DOCUMENTS

| | | | |
|---|---|---|---|
| 1,481,358 | 1/1924 | Dwyer | 417/440 |
| 3,088,659 | 5/1963 | Nilsson | 418/159 |
| 3,151,806 | 10/1964 | Whitfield | 418/159 |
| 3,314,597 | 4/1967 | Schibbye | 418/203 |
| 3,388,854 | 6/1968 | Olofsson | 418/203 |
| 3,687,572 | 8/1972 | Glanvall | 417/283 |
| 3,936,239 | 2/1976 | Shaw | 418/201 |
| 3,989,413 | 11/1976 | McGahan | 418/206 |
| 4,042,310 | 8/1977 | Schibbye | 418/201 |
| 4,335,582 | 6/1982 | Shaw | 417/310 |

FOREIGN PATENT DOCUMENTS

| | | | |
|---|---|---|---|
| 958364 | 5/1964 | United Kingdom | 418/201 |

*Primary Examiner*—Leonard E. Smith
*Assistant Examiner*—Jane E. Obee
*Attorney, Agent, or Firm*—Wood, Dalton, Phillips, Mason & Rowe

[57] ABSTRACT

The invention relates to a valve system for capacity control of an oil-injected screw compressor. One or more valves (17–20), preferably at least two valves, are located in the wall of the rotor barrel (12, 13). The pressure in the compressed-air tank of the compressor actuates control valves, which in their turn open or close the valves (17–20). When the valves are opened, a direct connection between two consecutive thread volumes of at least one of the rotors (14, 15) is established, whereby the closed space capable to be used for the internal compression, is reduced.

19 Claims, 3 Drawing Figures

VALVE SYSTEM FOR CAPACITY CONTROL OF SCREW COMPRESSORS

This invention relates to a valve system for an oil-injected screw compressor of the kind comprising a housing including a compression space consisting of two rotor barrels defined by two intersecting bores and with a low-pressure opening at one end and a high-pressure opening at the other end, and two meshing rotors mounted rotatably in the rotor barrels, which valve system is to be connected to the cylindric rotor bores and intended to control the capacity of the compressor operating at a constant number of revolutions.

Several solutions for controlling the capacity of screw compressors operating at a constant number of revolutions are previously known.

One of these solutions is disclosed in patent application SE-8004091-8. At this solution as well as at other known valve systems at screw compressors the valves are arranged so as to open a connection between the compression space and a drain duct in order thereby to control the capacity of the screw compressor.

The present invention has the object to bring about a simple valve system with a low space requirement for controlling the capacity of screw compressors of the aforesaid kind. The valve system preferably should also be capable to unload the compressor during starting up and, besides, to prevent efficiency losses, which otherwise occur easily by other valve types at full load. By means of the valve system according to the invention the compressor capacity can be controlled in steps whereby the valves operate only in fully closed or fully open position.

The aforesaid valve system is achieved in that the invention has been given the characterizing features defined in the attached claims.

Figure 1:
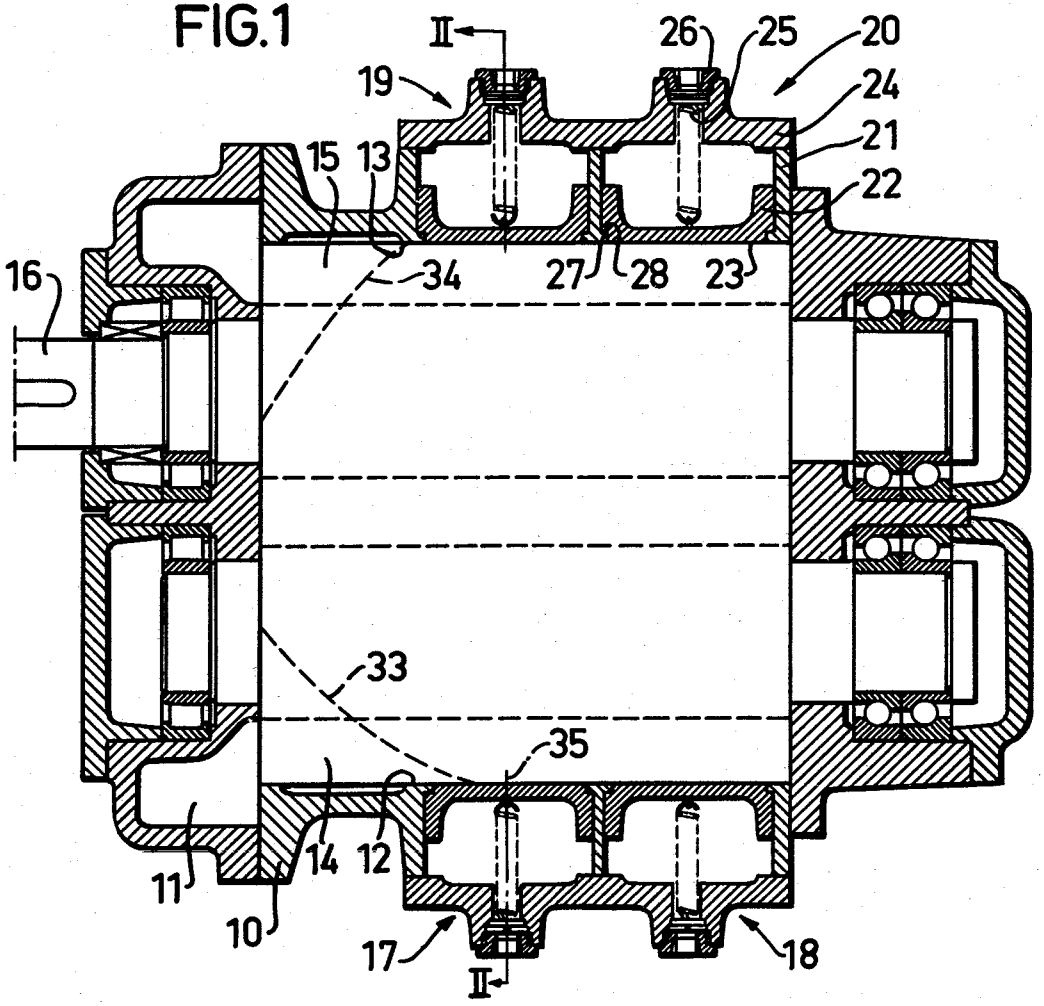
Figure 2:
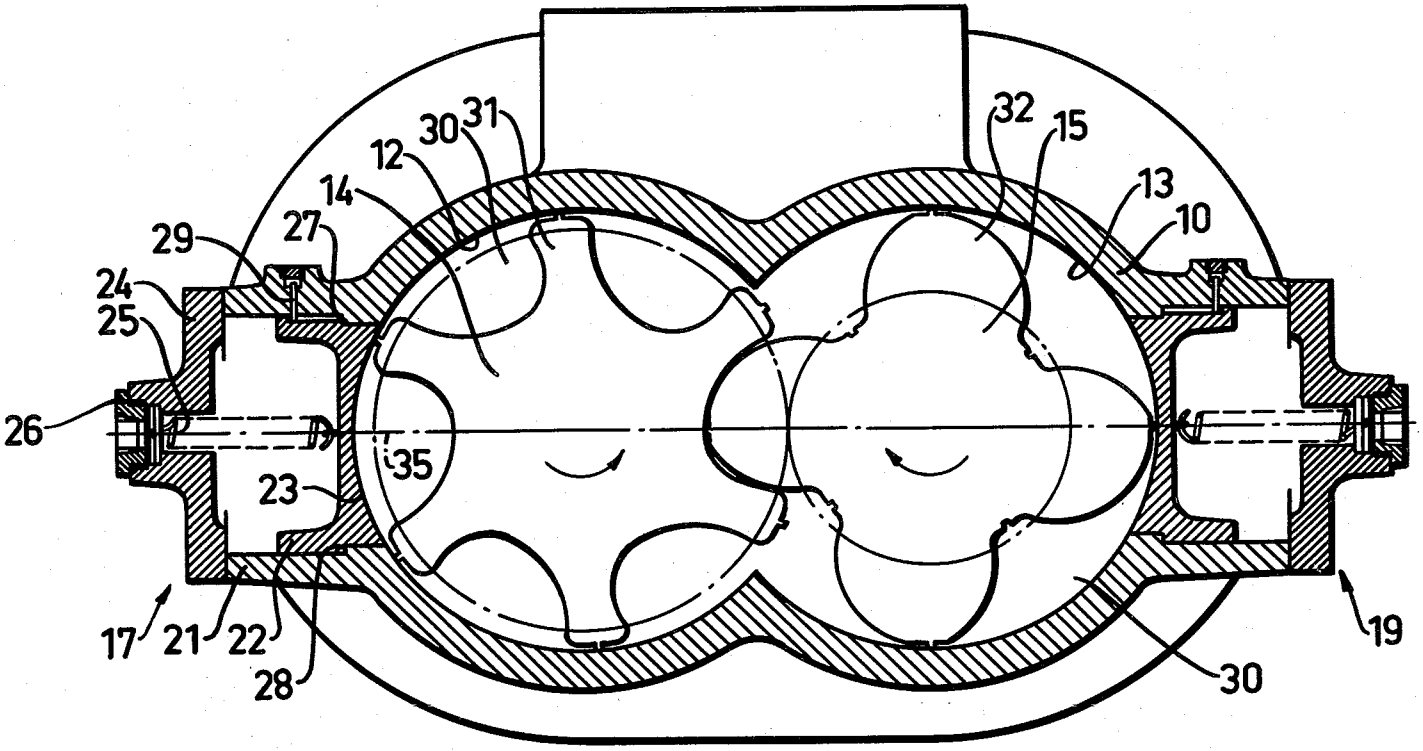
Figure 3:
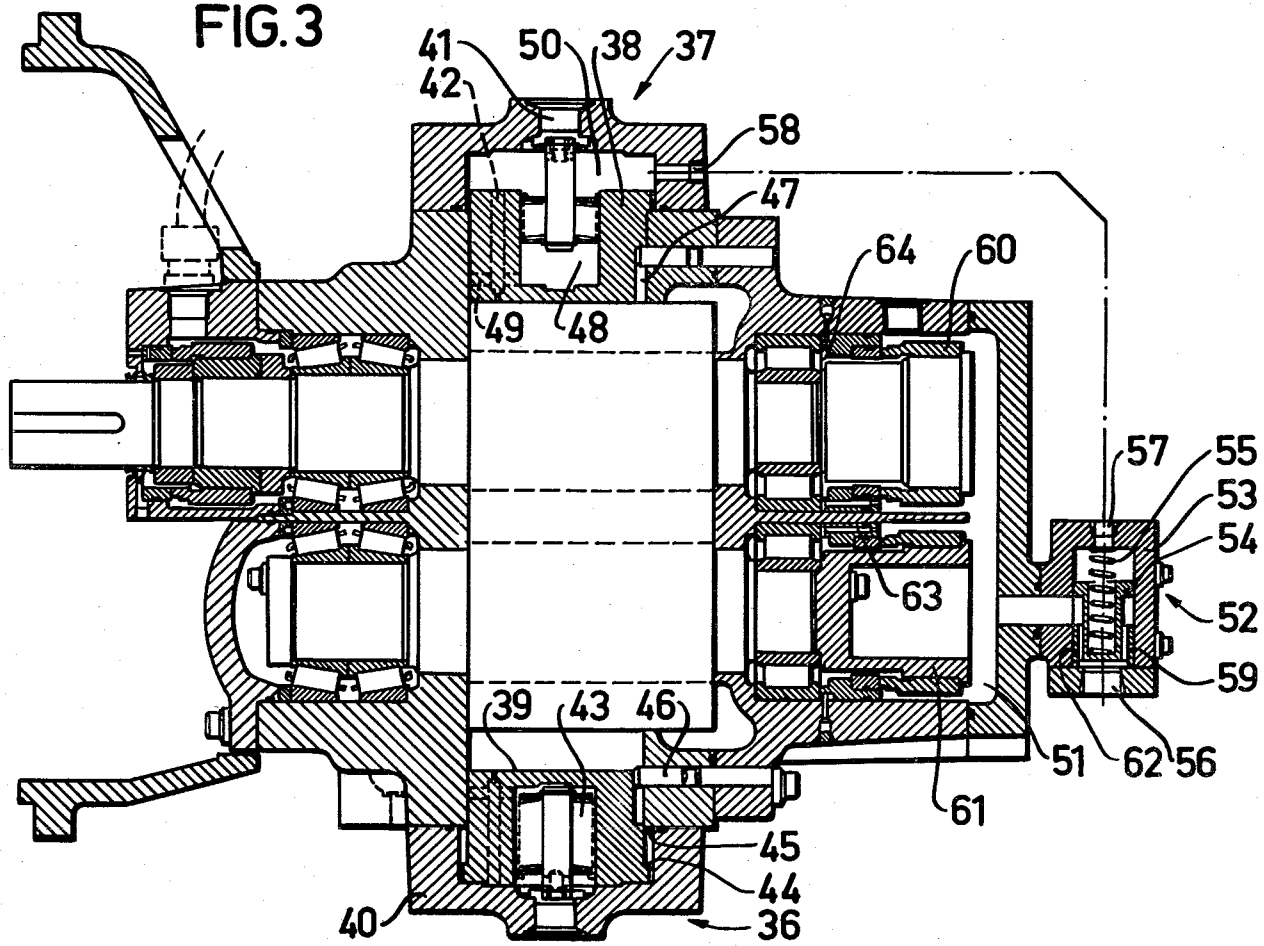

The invention is described in greater detail in the following by way of an embodiment thereof and with reference to the accompanying drawings, in which FIG. 1 is a horizontal section through a screw compressor equipped with a valve system according to the invention, FIG. 2 is a vertical section through the compressor at the line II—II in FIG. 1, and FIG. 3 is a horizontal section through a screw compressor equipped with a different embodiment of the valve system.

The screw compressor comprises a housing 10 with a low-pressure opening 11 on one side and a high-pressure opening (not shown) on the other side. In said housing 10 two intersecting rotor bores 12, 13 are provided which form two rotor barrels, in which two meshing rotors 14, 15 are mounted. The male rotor 15 thereof is driven by an input drive shaft 16, while the female rotor 14 is driven by the male rotor.

As appears from FIG. 1, two valves 17, 18 and 19, 20 for each bore are located on the substantially vertical outer surfaces of the two rotor bores 12, 13. The valves 17, 18 for the female rotor bore 12 are located substantially diametrically straight across the valves for the male rotor bore 13.

Each valve 17, 18, 19, 20 comprises a valve housing 21 with a cylindric valve piston 22 slidingly movable therein, of which the end wall surface 23 facing inward to the rotor constitutes a valve disc, which simultaneously constitutes a portion of the cylindric wall of the compression space, i.e. a portion of the rotor bore. The valve housing 21 is defined outwardly by a cover 24. Between said cover 24 and the valve piston 22 a tension spring 25 is clamped, which tends to lift the valve piston. The cover 24 also is provided with a connection 26 for the supply of a pressure medium for closing the valve.

In order to align the disc ends of the valve pistons 22 with the rotor bore and to prevent the discs from projecting inside the bore and contacting the rotors, a shoulder 27 is provided in the wall of the valve housing, against which shoulder 27 a shoulder 28 on the piston 2 sealingly abuts when the valve is closed. In the valve housing 21 a pin 29 is fixed which engages with a groove in the valve piston 22 to guide the piston and prevent it from turning.

At full load operation of the compressor all valves 17, 18, 19, 20 are closed and the shoulders 28 of the pistons sealingly abut the shoulders 27 in the walls of the valve housings. The valves are maintained closed in that oil under pressure is supplied through the connection 26 in the covers 24 to the interior of the valve housings. Said connections 26 preferably are connected each to a three-way valve (not shown), through which oil is supplied at a pressure substantially equal to the discharge pressure of the compressor. The three-way valves preferably are actuated automatically by the pressure in the discharge air tank. When the pressure in this air tank exceeds a certain value, at first the three-way valve for the valve 17 is actuated, whereafter the three-way valves for the valves 19, 18 and 20 are by turn actuated until maximum unload is obtained. Hereby the oil pressure in the respective valve housing is relieved, whereby the pistons 22 automatically are opened by the tension springs 25.

When the valve 17 is being opened, thus, a connection between two adjacent thread volumes 30 of the female rotor 14 is established, so that in these thread volumes no compression can take place until after these thread volumes have passed the valve 17. The same applies to the valve 18 and even to the valves 19 and 20 on the male rotor side. During the stepped control process, thus, an overflow connection between two thread volumes is obtained alternatingly on the female and male rotor side.

The female rotor 14 has a pitch steeper than that of the male rotor 15, which implies that a lobe 31 of the female rotor 14 arrives at the valve 17 prior to the arrival of a corresponding lobe 32 of the male rotor to the valve 19. When the lobe 32 of the male rotor arrives at the valve 19, the lobe 31 of the female rotor has moved to be directly in front of the centre of the valve 17. When the lobe 31 has arrived at the end of the valve 17, the lobe 32 of the male rotor is directly in front of the valve 19. Hereby a substantially constant overflow area between the thread volumes 30 is obtained when these two valves are open at the same time. A corresponding result is obtained when the valve 18 and finally the valve 20 are being opened.

The dashed lines 33 and 34 indicate the closing positions of the inlet ports for the respective rotor barrel. The valve 17 has such a position axially in the rotor barrel, that its centre substantially coincides with the closing line 33. When the valve 17 opens, thus, a connection is established between a thread volume communicating with the compressor inlet 11 and the thread volume 30 in the female rotor which just has commenced the internal compression progress. Hereby a return flow to the compressor inlet is obtained which runs from this thread volume 30 above the rotor lobe 31 via the valve area, which has been formed in the valve housing owing to the valve piston being in its opened position. As the valve disc preferably is designed with a diameter corresponding substantially to the width of the thread 30 perpendicularly to the thread pitch, a capacity control down to only about 93% is obtained when only the valve 17 is open. This valve, however, has the main object to ensure a sufficient overflow area to the thread volume communicating with the inlet port in cases when one or more of the remaining valves 18, 19, 20 are open.

Two, three or four valves are successively opened whereby a step-by-step capacity reduction to about 80, 65 and, respectively, 50% of full capacity is calculated to be obtainable.

In FIG. 3 an embodiment of the radially movable valves is shown which is different of that shown in FIGS. 1 and 2. Each control valve 36, 37 consists of a radially slidable cylindric valve piston 38, the surface 39 of which facing to the rotors constitutes a portion of the cylindric wall of the compression space when the valve is in its closed position. The control valve is defined outwardly by a cover 40. Between said cover and the valve piston 38 a tension spring device of cup spring type 43 is clamped, which tends to lift the piston to its relieved position. As can be seen from FIG. 3, the cup spring 43 consists of a compression spring fixed at the end of the pin nearest the rotors and fixed at its other end to the piston 38. The cover 40 is provided with a connection 41 for the supply of pressure oil in order to partly effect a force for closing the control valve and partly supply oil through the connecting bore 42 to the compression space. The valve pistons 38 are formed with a shoulder 44, which sealingly abuts the surface 45 in the compressor housing when the valves 38 are closed. Said shoulder 44 is dimensioned so that the pistons 38 when fixed in their closed position with their surface 39 then substantially coincides with the bore for the respective rotor 14, 15. For guiding the pistons 38 from a rotation aspect, pins 46 are provided in the compressor housing to engage with grooves 47 in the pistons. For draining the cup spring housing 48, a hole 49 is drilled in the piston 38 so as to establish connection to the bore 42.

At full load operation of the compressor, both valves 36, 37 are closed entirely, and the shoulders 44 of the pistons sealingly abut the shoulders 45 in the compressor housing. The valves are adjusted to their closed position and are maintained closed by means of the pressure of the oil which is supplied to the valve housing 50 through the connections 41 in the valve covers 40. The connections 41 preferably are connected each by a three-way valve (not shown), through which oil is supplied from an oil separator (not shown) in the outlet system of the compressor. Said three-way valves preferably are actuated automatically by the pressure in the compressed-air tank (not shown) of the compressor. When the pressure in this tank exceeds a certain value, at first the three-way valve for the valve 36 is actuated, whereafter the three-way valve for the valve 37 is actuated, so that the oil pressure in the respective valve housing 50 is relieved, and the pistons 38 automatically are opened by the cup springs 43 until finally maximum unloading is obtained. The way, in which the unloading procedure in the compression space proceeds when the valves 36, 37 are being opened has above already been described in detail.

As shown in FIG. 3, oil is supplied to the compression space via passageways 42 in the pistons 38. This oil supply, however, occurs only when the pistons 38 are in their closed position when always full oil pressure prevails in the valve housing 50. When the valves 36, 37 are unloaded due to shutting off the oil pressure and thereby the oil supply through the connections 41, also the supply of oil via the passageways 42 to the compression space is stopped automatically. This is of essential importance for the compressor efficiency at part load, due to the fact that heated oil is then prevented from being supplied to that part of the compression space which at part load communicates directly with the suction side of the compressor. The passageways 42 in the pistons 38 are drilled in optimum positions for the efficiency of the compressor when operating at full load.

At minimum load operation of the compressor, i.e. when both valves 36, 37 are open, the axial gas forces on the rotors decrease substantially compared with corresponding forces at full load operation, i.e. when the valves 36, 37 are closed. At said minimum load and at unchanged inlet and outlet pressures in the compressor, an overbalancing of the axial forces on the rotors is obtained if the oil pressure in the balancing piston housing 51 would be maintained. In order to adjust the oil pressure to the load in the compressor, a control valve 52 is added. A valve piston 54 movable in the housing 53 of said valve is actuated by a pressure spring 55 and by oil pressure connections 56 and 57. When the control valve 37 is in its closed position, the valve piston 54 is actuated on its upper end by full oil pressure through the connection 57, which via the connection 58 communicates with the valve housing 50 in the valve 37. Simultaneously also the lower end of the control valve 52 is actuated by the full oil pressure via the connection 56. Owing to the force from the pressure spring 55, the valve piston 54 is forced to its open position, as shown in FIG. 3. Hereby the full oil pressure is transferred into the balancing piston housing 51 through overflow passageways 59 in the valve piston 54, and the balancing pistons 60, 61 are hereby actuated by their maximum force. When, however, the control valve 37 is opened, the oil pressure to the upper surface of the valve piston 54 is relieved, and the piston is moved to its closed position. The oil supply to the balancing piston housing 51 via the passageways 59 is hereby interrupted, and this oil supply, instead, runs via passageways 62, which have a substantially smaller flow area than the passageways 59. By adjusting this area 62 to the by-pass area in the passageways 63 connecting the balancing piston housing 51 to the compression space via the inlet bearing housings 64, the oil pressure in the housing 51 can be adjusted so that the desired reduction of the force on the balancing pistons 60, 61 can be obtained.

For being able to entirely unload the compressor, the valves can be completed with a throttling of some kind of the compressor inlet.

By designing the valves in the way opened by the invention, the total dimension of the compressor has been considerably reduced compared to previously proposed valve systems, partly because the total valve length has been shortened but above all owing to the fact that it has been possible to omit any external passageway in the compressor housing. The stroke of the valve pistons also has been reduced considerably, and thereby the risk that the valves would be locked due to the so-called drawer effect has been eliminated. The valves can hereby be given a much simpler design, which in its turn renders the manufacture of the valves cheaper. The control valves, at least at one end and the same rotor, can be designed identical, which also contributes to decreased manufacturing costs.

What we claim is:

1. A valve system for capacity control and unloading of oil-injected gas compressors of screw compressor type, at which at least one valve is provided to be connected to that portion of the rotor bores (12, 13) which constitutes the cylindric walls of the compression spaces, said valve constituting a portion of said cylindric walls of the compression spaces in its closed position and which can be opened for establishing a continuous connection between pairs of consecutive thread volumes (30) of one of the rotors, characterized in that each valve is of piston-type movable in a cylindric bore radially to the rotor bores and that a first of said valves (17) is so positioned that its centre line substantially intersects the line (33) which corresponds to the closing position of the inlet port in one rotor bore.

2. A valve system as defined in claim 1, characterized in that two valves (17–20) are provided, one at each rotor (14, 15), and that the centre of the valves is located in a plane through the centre of the two rotors (14, 15).

3. A valve system as defined in claim 2, characterized in that said valves (17–20) are so positioned in relation to each other that a constant overflow area is obtained between said consecutive thread volumes (30) when said valves are successively being opened.

4. A valve system as defined in claim 2, characterized in that the peripheral edge of the piston disc of the valve (19) on the other rotor bore, which edge is closest to the inlet, is located so that it substantially intersects the line (34) constituting the closing position of the inlet port on the other rotor bore.

5. A valve system as defined in claim 1, characterized in that four valves, (17, 18, 19, 20) are provided, two at each rotor (14, 15), and that the centre of the valves is located in a plane through the centre of the two rotors (14, 15).

6. A valve system as defined in claim 5, characterized in that the valves are arranged so that, depending on the demand of capacity control, one, two, three or four valves can be unloaded.

7. A valve system as defined in claim 6, wherein the compressor includes a male rotor and a female rotor, characterized in that the valves are arranged to be successively unloaded as follows: the valve (17) located closest to the inlet on the female rotor side—the valve (19) located closest to the inlet on the male rotor side—the second valve (18) located on the female rotor side—the second valve (20) located on the male rotor side.

8. Valve system as defined in claim 3, characterized in that the valves on at least the same rotor are designed identical.

9. A valve system as defined in claim 1, characterized in that each valve comprises a valve housing and a cylindric valve piston (22;38) slidably movable therein, the disc end surface (23;39) of said piston facing to the rotor constitutes a portion of the cylindric wall of the compression spaces when the piston is in its closed position.

10. A valve system as defined in claim 9, characterized in that in the wall of the valve housing a shoulder (27;45) is located, against which a shoulder (28;44) on the piston (22;38) abuts when the valve is closed.

11. A valve system as defined in claim 9, characterized in that in the valve housing a pin (29;46) is provided, which for guiding the piston (22;38) engages in a groove in the piston (22;38).

12. A valve system as defined in claim 9, characterized in that the piston (22) has a diameter corresponding substantially to the width of the groove (30) of the female rotor (14) perpendicularly to the pitch.

13. A valve system as defined in claim 9, characterized in that a tension spring (25;43) is provided for lifting the piston, while for closing the valve a connection (26;41) for the supply of a pressure medium is provided.

14. A valve system as defined in claim 13, characterized in that the tension spring is a cup spring (43).

15. A valve system as defined in claim 13, characterized in that between the connection (26;41) and the outlet system of the compressor a connection is provided for supplying oil from the discharge system as pressure medium.

16. A valve system as defined in claim 13, characterized in that the piston (38) is provided with a connecting bore (42) for the supply of oil to the compression space.

17. A valve system as defined in claim 16, characterized in that a control valve (52) is provided for controlling the oil supply to balancing pistons (60, 61) at the low-pressure ends of the rotors when the valves (36, 37) are unloaded.

18. A valve system as defined in claim 7, characterized in that the control valve (52) is connected to the valve housing (50) in the valve (37), so that the oil pressure prevailing in the valve housing (50) is supplied to the upper side (57) of the control valve (52), so that the control valve (52) is unloaded when the valve (37) is unloaded.

19. A valve system as defined in claim 17, characterized in that the control valve (52) comprises a piston (54) with passageways (62), the flow area of which is so adjusted in relation to the flow area in the passageways (63) connecting the housing (51) of the balancing pistons (60, 61) to the inlet bearing housings (64) of the rotors, that a reduction of the oil pressure in the balancing piston housing (51) and thereby also of the balancing force on the balancing pistons (60, 61) is obtained when the control valve (52) is in its unloaded position.

* * * * *